US008087182B2

(12) United States Patent
Steffens

(10) Patent No.: US 8,087,182 B2
(45) Date of Patent: Jan. 3, 2012

(54) METHOD FOR OPERATING A CONDENSER TUMBLE-DRYER COMPRISING CONDENSER TUMBLE DRYER THAT IS SUITABLE FOR SAID METHOD

(75) Inventor: Günter Steffens, Dallgow-Döberitz (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 309 days.

(21) Appl. No.: 12/593,639

(22) PCT Filed: Apr. 15, 2008

(86) PCT No.: PCT/EP2008/054563

§ 371 (c)(1),
(2), (4) Date: Sep. 29, 2009

(87) PCT Pub. No.: WO2008/128931

PCT Pub. Date: Oct. 30, 2008

(65) Prior Publication Data

US 2010/0037480 A1 Feb. 18, 2010

(30) Foreign Application Priority Data

Apr. 20, 2007 (DE) ..... 10 2007 018 787

(51) Int. Cl.
*F26B 11/00* (2006.01)

(52) U.S. Cl. ..... 34/446; 34/413; 34/499; 68/18 C; 68/20; 236/44 C; 165/156; 165/287

(58) Field of Classification Search ..... 34/380.381, 34/413, 446, 497, 499, 80, 90; 165/287, 165/156; 68/20, 18 C; 236/44 C
See application file for complete search history.

(56) References Cited

U.S. PATENT DOCUMENTS

| | | | | |
|---|---|---|---|---|
| 4,527,343 | A | 7/1985 | Danneberg | |
| 5,119,571 | A * | 6/1992 | Beasley | 34/446 |
| 7,191,543 | B2 * | 3/2007 | Yakumaru et al. | 34/77 |
| 7,908,766 | B2 * | 3/2011 | Ahn et al. | 34/595 |
| 2006/0179676 | A1 * | 8/2006 | Goldberg et al. | 34/77 |
| 2007/0017113 | A1 * | 1/2007 | Scharpf et al. | 34/86 |
| 2008/0034607 | A1 | 2/2008 | Ahn et al. | |
| 2010/0037480 | A1 * | 2/2010 | Steffens | 34/468 |
| 2010/0199515 | A1 * | 8/2010 | Steffens | 34/468 |
| 2011/0030238 | A1 * | 2/2011 | Nawrot et al. | 34/499 |

(Continued)

FOREIGN PATENT DOCUMENTS

DE 3113471 A1 10/1982

(Continued)

*Primary Examiner* — Stephen M. Gravini
(74) *Attorney, Agent, or Firm* — James F. Howard; Andre Pallapies

(57) ABSTRACT

A method for operating a condenser tumble dryer is provided and includes a drying chamber for containing objects to be dried, a process air circuit having a heating element, a fan for conducting heated process air over the objects, a heat pump circuit having an evaporator, a compressor, and a condenser, and sensors for determining the humidity in the objects to be dried. According to the method, the humidity is determined and the process air is heated by the condenser until the humidity ranges between about 0% and about 12%. In the event that the humidity drops below the predetermined value, the heating element is activated and operated for at least five minutes so that the air temperature in the drying chamber reaches at least 70° C.

10 Claims, 1 Drawing Sheet

U.S. PATENT DOCUMENTS

| | | | | |
|---|---|---|---|---|
| 2011/0036556 | A1 * | 2/2011 | Bison et al. | 165/287 |
| 2011/0167670 | A1 * | 7/2011 | Stamm et al. | 34/491 |
| 2011/0198405 | A1 * | 8/2011 | Krausch et al. | 236/44 C |

FOREIGN PATENT DOCUMENTS

| | | | |
|---|---|---|---|
| DE | 3406678 | A1 * | 9/1985 |
| DE | 4304226 | A1 | 8/1994 |
| DE | 102005041145 | A1 | 3/2007 |
| DE | 102007018787 | A1 * | 10/2008 |
| JP | 01142357 | A * | 6/1989 |
| JP | 03279727 | A * | 12/1991 |
| JP | 06137643 | A * | 5/1994 |
| JP | 2003042510 | A * | 2/2003 |
| JP | 2003336950 | A * | 11/2003 |

* cited by examiner

METHOD FOR OPERATING A CONDENSER TUMBLE-DRYER COMPRISING CONDENSER TUMBLE DRYER THAT IS SUITABLE FOR SAID METHOD

BACKGROUND OF THE INVENTION

The invention relates to a method for operating a condenser tumble dryer with a drying chamber for the objects to be dried, a process air circuit in which a heating element for heating the process air is situated and the heated air is conducted over the items to be dried using a fan, a heat pump circuit with an evaporator, a compressor and a condenser, as well as sensors for determining the humidity in the objects to be dried, as well as to a condenser tumble dryer that is suitable for said method. The method is suitable for disinfection of the objects, which are especially items of laundry.

Tumble dryers which function on the basis of condensing from the process air taken away from the laundry the moisture evaporated from the laundry by the warm process air—known as condenser dryers—do not need a vented air hose and are very popular since they can be used in an internal bathroom or in a washing and cooking area of a larger residential complex. This applies both to tumble dryers designed specifically for drying laundry and also to so-called washer/dryers, i.e. appliances that can both wash the laundry and also dry it. Any subsequent reference to a tumble dryer or condenser dryer thus applies both to an appliance designed only for drying as well as an appliance designed equally for washing and drying.

In a condenser tumble dryer air (so-called process air) is directed via a fan over a heating element into a drum containing items of wet laundry acting as a drying chamber. The hot air takes up humidity from the items of laundry to be dried. After passing through the drum, the now moist process air is directed into a heat exchanger, upstream of which a lint filter is normally connected.

The moist air is cooled down in the heat exchanger, typically by a separately directed stream of cool air, so that the humidity contained in the moist process air condenses. The water arising from this process is subsequently generally collected in a suitable container and the cooled and dried air is fed once again to the heating element and subsequently to the drum.

This drying process is very energy-intensive, since the heat extracted in the cooling of the process air in the heat exchanger is lost whenever this heat is taken away in a cooling air stream. By using a heat pump this energy loss can be greatly reduced. In such cases the well-known compressor heat pump is used, in which a working or cooling medium to be condensed and evaporated in cycles circulates and which has numerous applications for cooling or air conditioning. For a condenser tumble dryer equipped with such a heat pump the warm process air laden with moisture is essentially cooled in a first heat exchanger of the heat pump, especially an evaporator, where the transferred heat is used for evaporating a coolant employed in the heat pump. Such coolant evaporated as a result of being heated up is fed via a compressor to a second heat exchanger, referred to here and below as an evaporator, where, as a result of the condensation of the gaseous coolant, heat is released which is used in its turn for heating up the process air before it enters the drum. The condensed coolant passes via a choke, which lowers its pressure, back to the evaporator in order to evaporate there while again taking up heat from the process air.

In a condenser dryer with a compressor heat pump a temperature of only 50° C. to 60° C. occurs in the drying chamber as a result of the process, which is generally not sufficient for the disinfection of the laundry. The disinfection in condenser dryers, especially the disinfection of items of laundry would however basically be possible without any problems were the drying chamber and thereby the items of laundry held in it to be kept for a sufficiently long period at a temperature of over 70° C.

BRIEF SUMMARY OF THE INVENTION

The object of the invention is thus to provide a method for operation of a condenser dryer of the generic type specified above, especially a condenser dryer with a heat pump with which disinfection can be carried out at higher temperature. A condenser dryer especially suitable for this method is also to be specified.

Preferred embodiments of the inventive method as well as preferred embodiments of the condenser dryer are detailed in the dependent claims. In such cases preferred embodiments of the condenser dryer correspond analogously to preferred embodiments of the method and vice versa, even if this is not stated explicitly.

One object of the invention is thus a method for operating a condenser dryer with a drying chamber for the objects to be dried, a process air circuit in which a heating element for heating the process air is situated and heated air is conducted over the objects to be dried using a fan, and a heat pump circuit with an evaporator, a compressor and a condenser, as well as sensors for determining the humidity in the objects to be dried, with the humidity being determined up to a predetermined value (F) of the humidity ranging from 0% to 12%, preferably 3% to 5%, the process air is heated by the condenser (15), preferably exclusively by the latter and after the value drops below this predetermined value (F) the heating element (18) is operated in a manner in which an air temperature of at least 70° C. exists in the drying chamber over a period of at least 5 minutes, preferably at most 40 minutes, especially preferably over a period of 10 to 15 minutes.

In a preferred embodiment of the inventive method the heat pump circuit will be switched off before an air temperature of 65° C. is reached. Especially preferably the heat pump is switched off when the heating element is switched on.

It is also preferred that an air-air heat exchanger which is optionally present in the condenser dryer be switched on when the heat pump circuit is switched off. This makes possible condensation of moisture present in the objects still to be dried, especially laundry, even with a heat pump circuit that is switched off (i.e. the condenser deactivated).

Preferably the heating element is operated so that an air temperature ranging from 70 to 80° C. obtains in the drying chamber.

The invention further relates to a condenser dryer for carrying out the inventive method with a drying chamber for the objects to be dried, a process air circuit in which a heating element for heating the process air is situated and heated air is conducted over the objects to be dried using a fan, and a heat pump circuit with an evaporator, a compressor and a condenser and a sensor arrangement for determining the humidity in the objects to be dried, with the condenser dryer being equipped with a control unit for switching on the heating element when a predetermined value (F) of the humidity ranging from 0 to 12%, preferably 3 to 5%, is reached and for switching off a heat pump circuit.

The inventive condenser dryer is equipped with a sensor arrangement comprising at least one sensor for determining the humidity in the objects to be dried. The sensor arrangement is generally located in the drying chamber.

Two electrodes can be introduced for example as sensors into the drying chamber, generally the laundry drum, such that they are in contact with the moist laundry items. An electrical voltage is applied to the electrodes and the current strength or the electrical conductivity value between the electrodes is measured. If the measured current strength or the measured electrical conductivity value falls below a predetermined threshold value, which corresponds to a predetermined humidity (F), this means that the end of a normal drying phase has been reached, which is followed in general by the inventive method leading to the disinfection of the items to be dried (laundry items). In general the control unit is then used to switch on the heating element and switch off the heat pump circuit. The disinfection of the items to be dried can be carried out via a separate program or as an integrated component at the end of a drying program.

In a preferred embodiment the inventive condenser dryer features an air-air heat exchanger and a control unit causes the air-air heat exchanger to be switched on when a predetermined value (F) of the humidity in the range 0 to 12% is reached.

In a preferred embodiment of the condenser dryer the air-air heat exchanger is removable. This is especially advantageous since it is easier to clean the lint off a removable heat exchanger.

The coolant used in the heat pump circuit is preferably selected from the group consisting of a butane/isopropane mixture, carbon dioxide and fluorocarbon compounds. These agents as such are known as coolants.

The heat pump in the inventive condenser dryer, in addition to an evaporator, condenser and compressor, has a pressure-relief valve in the flow direction of the coolant between the evaporator and the condenser (also referred to as a choke valve or a choke).

The coolant used in the heat pump circulates in the heat pump circuit preferably with a turbulent flow. A turbulent flow can be set by a suitable constructive design of a flow duct and/or by suitable drive units (e.g. compressor).

The temperature of the coolant of the heat pump, especially in the evaporator, is inventively generally held in the permitted range via the control of heat pump, heating element and air-air heat exchanger.

Inventively it is preferred for process air and cooling air or process air and coolant to be conducted in the heat pump in each case in a crossflow or counterflow method through the corresponding heat exchanger.

The heating element used in the inventive condenser dryer is preferably a two-stage heating element. The heating power of the heating element preferably ranges from 1000 to 2500 Watts, especially between 1300 and 2000 Watts.

Since, as the degree of drying of the objects to be dried in the condenser dryer progresses, the necessary energy for the drying decreases, it is expedient to regulate the heating element accordingly, i.e. with ongoing degree of drying to reduce its heating power in order to maintain an equilibrium between the drying energy supplied and the energy necessary.

To regulate the temperature of coolant or heat pump as well as the temperature of the process air, temperature sensors generally known to the person skilled in the art are used in the heat pump circuit and/or in the process air circuit.

The invention has the advantage of combining a favorable drying method in energy terms with the disinfection of the objects to be dried or the dry objects. Above and beyond this the disinfection can be achieved in a particularly gentle way. In addition the heat pump is protected.

BRIEF DESCRIPTION OF THE DRAWINGS

Further details of the invention emerge from the description giving below of a non-restrictive exemplary embodiment for a condenser dryer and a method for using this condenser dryer. This embodiment refers to FIG. 1.

Figure 1:
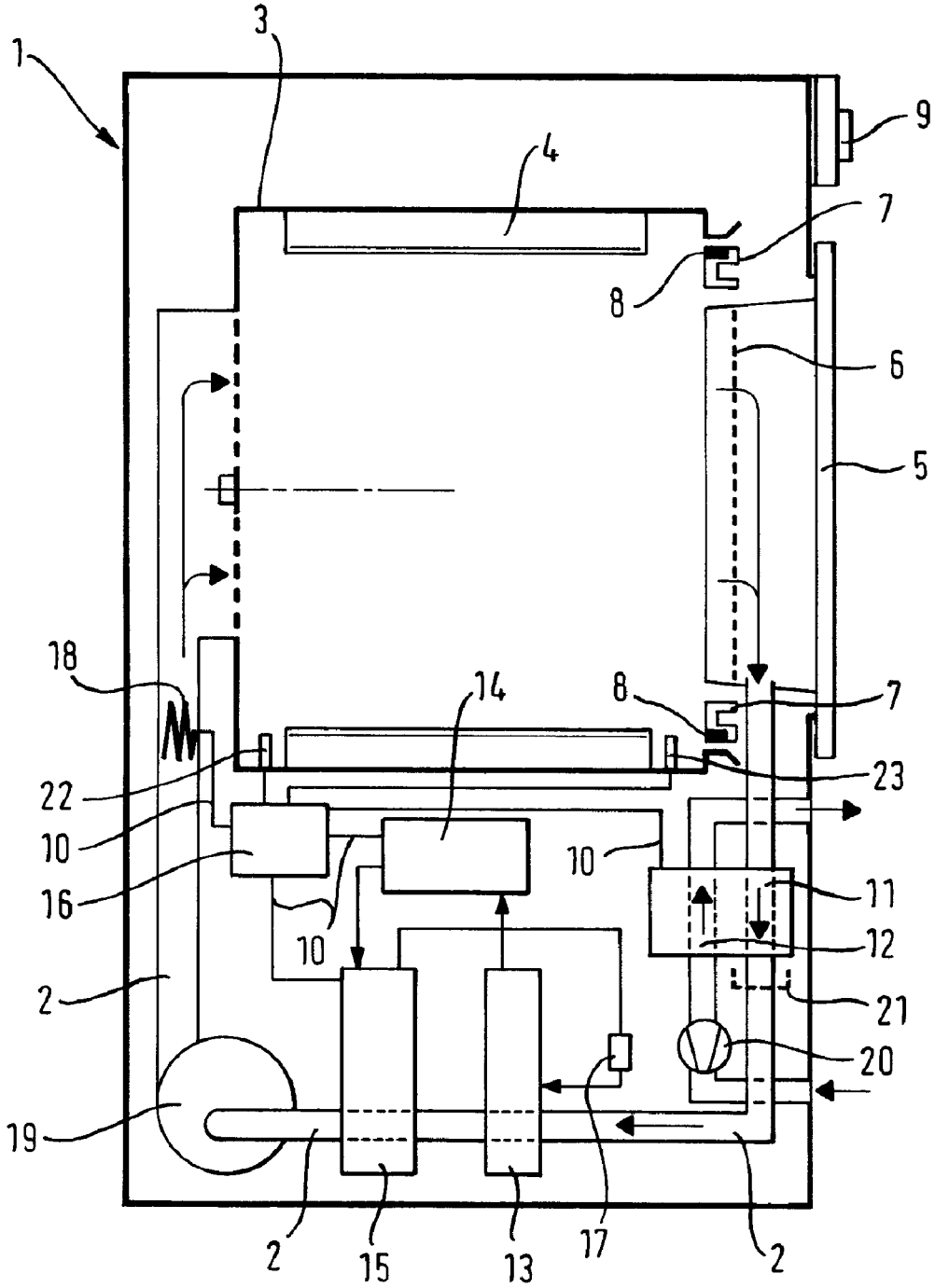

Detailed Description of Exemplary Embodiments of the Present Invention

FIG. 1 shows a vertical section of a condenser dryer (abbreviated to "dryer" below) in accordance with an exemplary embodiment of the invention with a heat pump circuit, a heating element and also an air-air heat exchanger.

The dryer shown in FIG. 1 has a drum rotatable about a horizontal axis as it drying chamber 3, within which agitators 4 are attached for moving the laundry during a drum rotation. Process air is conducted by means of a fan 19 over the heating element 18, through a drum 3, an air-air heat exchanger 11, 12 and also a heat pump 13, 14, 15 in an air duct 2 in a closed circuit (process air circuit 2). After passing through the drum 3, the moist, warm process air is cooled off and, after condensation of the humidity contained in the process air, is heated up again. In this case the air heated up by the heating element 18 is directed from behind, i.e. from a side of the drum 3 lying opposite a dryer door 5, through its perforated floor into the drum 3, comes into contact the with the laundry to be dried and flows through the filler opening of the drum 3 to a lint filter 6 within a dryer door 5 closing off the filler opening. Subsequently the stream of air is diverted in the drier door 5 downwards and directed from the air ducts 2 to the air-air heat exchanger 11, 12. There the moisture removed by the process air from the items of laundry condenses as a result of cooling off and is collected in a condensate container 21 shown by a dashed outline in FIG. 1, from where it can be disposed of. Subsequently the slightly cooled process air is conducted to the evaporator 13 of a heat pump 13, 14, 15, where it is cooled further. The coolant of the heat pump evaporated in this case in the evaporator 13 is conducted to the condenser 15 via a compressor 14. In the condenser 15 the coolant condenses while releasing heat to the process air. The coolant now present in liquid form is subsequently conducted via a choke valve 17 to the evaporator 13, by which the closed coolant circuit is formed. The cooling air is taken from the room air and after passing through the air-air heat exchanger 11, 12, is fed back into the room air. The number 20 indicates a fan in the cooling air duct 12 of the air-air heat exchanger.

Sensors 22 and 23 serve to determine the moisture in the objects to be dried, especially items of laundry. The signals of the sensors are fed to a control device 16 which in its turn is connected via lines 10 to the heating element 18, the heat pump circuit 13, 14, 15 and the air-air cooler 11, 12. The control device 16, depending on a predetermined humidity (F) and the humidity measured by the sensors 22 and 23, connects the heating element, switches off the heat pump circuit 13, 14, 15 and also switches on the air-air cooler 11, 12.

The drum 3 in the exemplary embodiment shown in FIG. 1 is supported on the rear base by means of a rotary bearing and at the front by means of an end bearing shield 7, with the drum 3 resting with a flange on a slider strip 8 on the end shield 7 and being held in this way at its front end. The control of the condenser dryer can be regulated by the user via an operating unit 9.

A drying method with disinfection is generally carried out when selected accordingly at the control unit 9. In this case the presence of the conventional heating element 18 as well as the heat pump 13, 14, 15 is utilized. Initially the items of laundry inserted into the drum 3 for drying are dried in a conventional energy-saving manner using the heat pump 13, 14, 15. The heat pump 13, 14, 15 cannot be used for the disinfection since it cannot function or can only function very badly at the high temperatures of the process air that are required for disinfection. Consequently it is thus switched off and only the conventional heating element 18 is used. Since the items of laundry are already largely dried their ability to accept heat is relatively low and the thermal power of the heating element 18 is sufficient for reaching the necessary high temperatures. If necessary, in addition to the deactivated heat pump 13, 14, 15, the air-air cooler 11, 12 can be deactivated in order to keep heat losses low. The disinfection is then carried out by appropriate heating up of the items of laundry. If necessary the air-air cooler 11, 12 can be used for a subsequent rapid cooling off of the items of laundry.

Overall the invention provides a new, sensible and useful application option for a tumble dryer of the hybrid type.

The invention claimed is:

1. A method for operating a condenser dryer with a drying chamber for retaining objects to be dried, a process air circuit having a heating element for heating the process air in the drying chamber, and a heat pump circuit for heating process air with the heat pump circuit including an evaporator, a compressor, and a condenser, and a sensor arrangement for determining a level of humidity in the objects to be dried, the method comprising the steps of:

determining humidity within the drying chamber using the sensor arrangement;

in the event that the humidity is determined to be equal to a predetermined humidity value of between about 0% to about 12%, heating the process air using the heat pump circuit; and in the event the humidity is determined to be less than the predetermined humidity value, activating the heating element to heat the process air in the drying chamber to a predetermined temperature value of at least 70° C. for a predetermined time period.

2. The method according to claim 1 and further comprising the step of deactivating the heat pump in the event the temperature value of the process air in the drying chamber is less than 65° C.

3. The method according to claim 1 and further comprising the step of deactivating the heat pump when the heating element is activated.

4. The method according to claim 1 and further comprising the step of deactivating the heat pump and activating an air-air heat exchanger.

5. The method according to claim 1, wherein the predetermined humidity value is between about 3% and about 5%.

6. The method according to claim 1, wherein the predetermined time period is between about 10 and about 15 minutes.

7. The method according to claim 1, wherein the predetermined temperature value is between about 70° C. to about 80° C.

8. A condenser dryer comprising:

a drying chamber for the objects to be dried;

a process air circuit including a heating element for heating the process air to a temperature of at least 70° C.;

a fan for conducting heated process air over the objects to be dried;

a heat pump for heating process air, the heat pump having an evaporator, a compressor, and a condenser;

a sensor arrangement for determining a level of moisture of the objects to be dried, the sensor arrangement being operable for determining a humidity value in the drying chamber; and a control unit for activating the heat pump for heating the process air using the evaporator in the event that the humidity is determined to be equal to a predetermined value between about 0% to about 12%; and for activating the heating element to heat the process air in the drying chamber to a predetermined temperature value of at least 70° C. for a predetermined time period in the event that the humidity value is determined to be less than the predetermined humidity value.

9. The condenser dryer according to claim 8 and further comprising an air-air heat exchanger and, in the event the sensor arrangement determines that the humidity is between about 0% to about 12%, the control unit activates the air-air heat exchanger.

10. The condenser dryer according to claim 9, wherein the air-air heat exchanger is removable from the condenser dryer.

* * * * *